US005379992A

United States Patent [19]

Holmes et al.

[11] Patent Number: 5,379,992

[45] Date of Patent: Jan. 10, 1995

[54] MAIL SORTING DEVICE

[75] Inventors: Lawrence B. Holmes, Hunt Valley, Md.; Roberto Facciolo, Genoa, Italy; Andrea Faure, Genoa, Italy; Nedo Gennari, Genoa, Italy; Vincenzo Priolo, Genoa, Italy

[73] Assignee: Finmeccanica S.p.A., Italy

[21] Appl. No.: 95,164

[22] Filed: Jul. 20, 1993

[30] Foreign Application Priority Data

Aug. 10, 1992 [IT] Italy ..... TO92A000693

[51] Int. Cl.[6] ..... B15H 1/02

[52] U.S. Cl. ..... 271/2; 271/31.4; 271/98; 271/107; 271/148; 271/150; 271/265; 414/798.9

[58] Field of Search ..... 271/2, 98, 104, 105, 271/107, 31.1, 265, 150, 151, 103, 148; 414/798.9

[56] References Cited

U.S. PATENT DOCUMENTS

| | | | |
|---|---|---|---|
| 1,292,641 | 1/1919 | Pedrick | 271/31.1 X |
| 2,572,509 | 10/1951 | Novick | 271/150 |
| 2,584,730 | 2/1952 | Novick | 271/150 |
| 2,847,213 | 8/1958 | Duncanson | 271/150 |
| 3,598,400 | 8/1971 | Nelson | 271/150 |
| 4,346,876 | 8/1982 | Guenther | 271/31.1 X |
| 4,588,180 | 5/1986 | Ballestrazzi | 271/150 X |
| 4,867,430 | 9/1989 | Volat | 271/150 X |
| 4,867,432 | 9/1989 | Matta | 271/150 X |
| 4,891,088 | 1/1990 | Suyatsky | 271/150 X |
| 4,955,596 | 9/1990 | Ricciardi | 271/265 X |
| 5,014,979 | 5/1991 | Higgins | 271/150 X |
| 5,181,707 | 1/1993 | Takei | 271/265 X |
| 5,219,432 | 6/1993 | Delbe | 271/103 |

*Primary Examiner*—Richard A. Schacher
*Attorney, Agent, or Firm*—Palmatier, Sjoquist & Helget

[57] ABSTRACT

A device whereby a pile of rectangular items is placed on an inclined surface and pushed towards the straight front edge thereof by a push unit. The surface presents two pairs of conveyor belts parallel to each other and coplanar with the surface; and the pile is arrested upon a bottom portion of the first item in the pile activating a first or second limit stop sensor, which activates a respective pair of belts so as to move the bottom left or right portion of the item and so orient the item in relation to a gripping plane. A gripping unit with two suction cups movable along a three-dimensional trajectory grips the oriented item and feeds it to a follow-up conveyor belt.

32 Claims, 5 Drawing Sheets

MAIL SORTING DEVICE

BACKGROUND OF THE INVENTION

The present invention relates to a device for sorting flat, rectangular items, particularly mail.

Mail sorting machines for flat, substantially rectangular items, such as enveloped documents, magazines, folded newspapers, etc., i.e. which are relatively thin as compared with the two front face dimensions, are supplied by upstream stages in the process with a normally disordered, substantially heterogeneous pile of said items.

Due to the difficulty encountered in automatically withdrawing the various items from the pile and feeding them on to the input device of a follow-up machine (e.g. a conveyor belt), this is therefore done manually by an operator.

SUMMARY OF THE INVENTION

It is an object of the present invention to provide a machine for automatically withdrawing flat mail items from even a highly heterogeneous pile, and feeding them on to a conveyor device connected to a mailing machine.

According to the present invention, there is provided a sorting device for flat, rectangular items, characterized by the fact that it comprises:

- at least one supporting surface for supporting a pile of said items;
- gripping means facing an end edge of said supporting surface and having at least one gripping head designed to releasably engage the front surface of said items;
- first handling means activated by first drive means, having at least one portion cooperating with said pile, and which provide for pushing said items towards said edge; and
- sensor means for detecting the position of said item in relation to a gripping plane (P);
- said sensor means being designed to emit a signal for activating said gripping means upon said item being positioned in said gripping plane (P); and
- said gripping means being moved by second drive means between at least a first position, wherein said head is positioned facing said item and substantially coplanar with said gripping plane (P), and a second unloading position wherein said head is so positioned as to unload said item.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
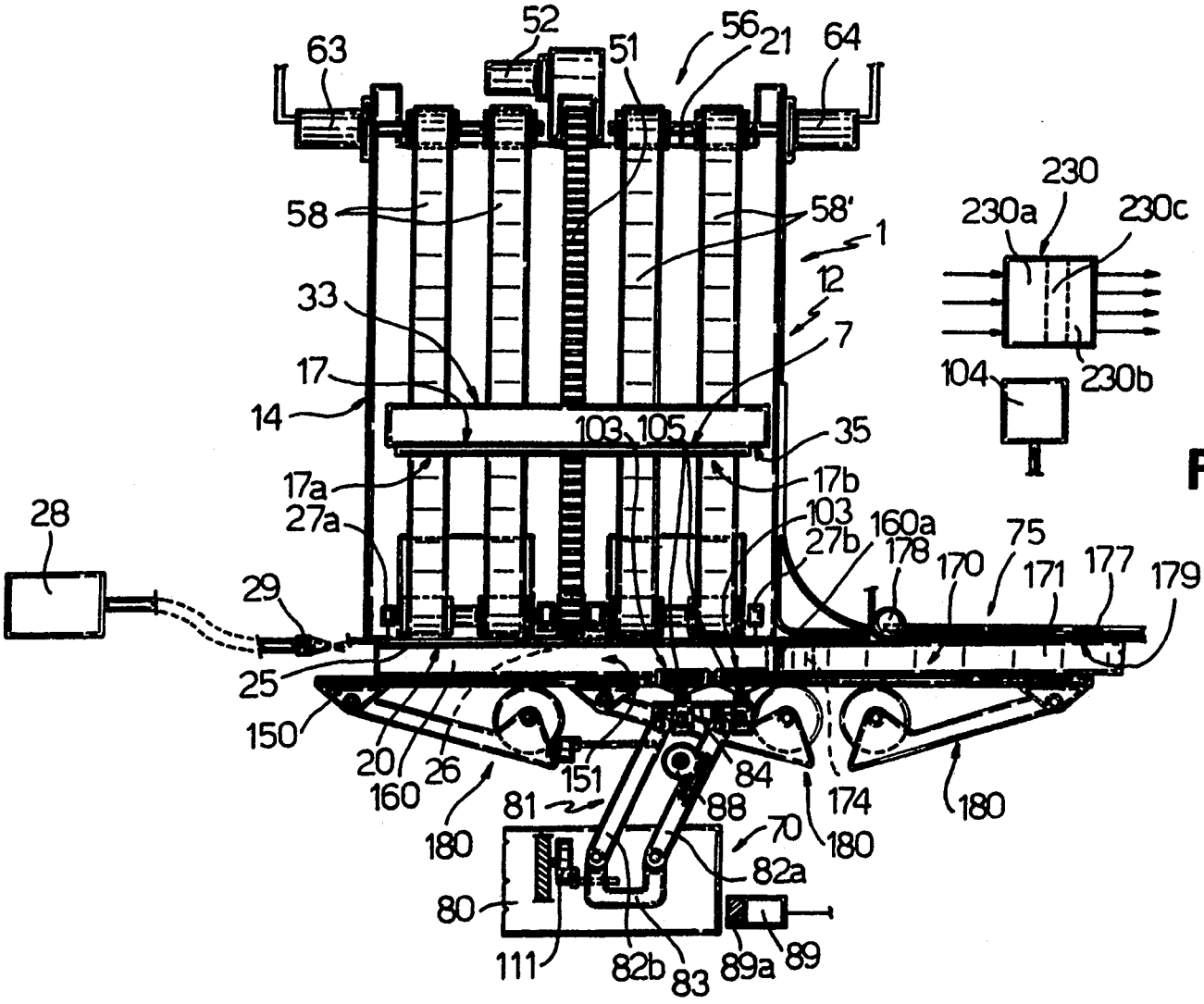
FIG. 1 shows a top plan view of a mail sorting device in accordance with the teachings of the present invention.
Figure 2A:
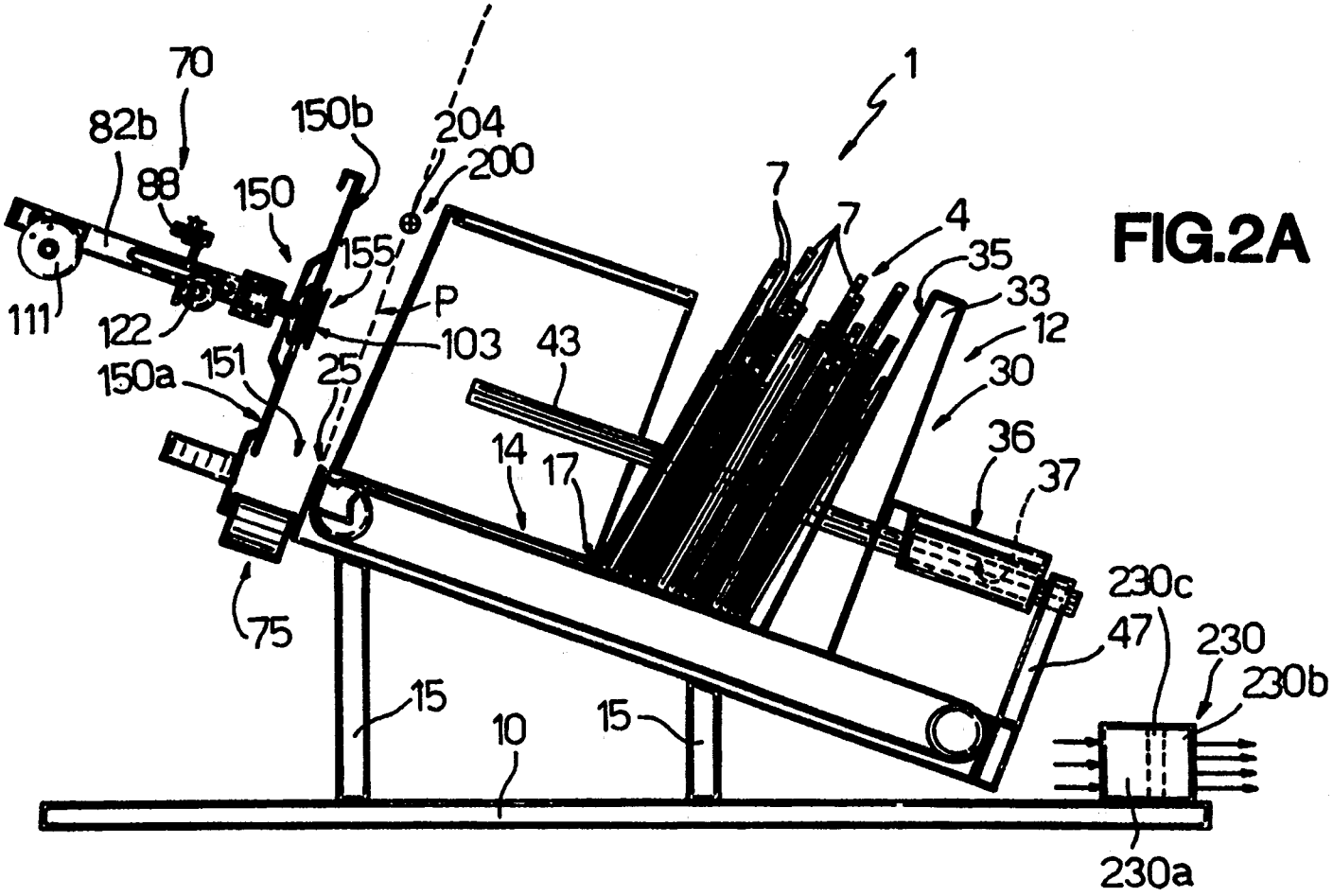
FIG. 2 shows a side view of the FIG. 1 device.
Figure 2B:
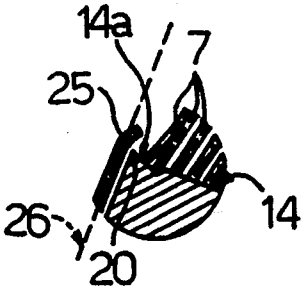

Number 1 in FIGS. 1 and 2 indicates a sorting device for a pile 4 of rectangular items 7, principally flat mail items (e.g. enveloped documents, cellophane-wrapped or banded magazines and newspapers, parcels, etc.).

Said items are conveniently 200–380 mm long; 100–280 mm wide; up to 25 mm thick; and weigh at most two kilograms.

Device 1 is mounted on a flat base 10 (FIG. 2) supporting a translating device 12 comprising a rectangular surface 14, which slopes roughly 10° in relation to the base, and is fitted to the base by means of brackets 15. Surface 14 supports pile 4 of items 7, each of which is arranged with a straight bottom edge 17 contacting surface 14.

Surface 14 presents a ramp type end portion **14*a* with a straight front end edge 20 facing a limit stop element 25 consisting of an elongated rectangular blade perpendicular to surface 14 and having a central portion hinged to a pin 26 defining an axis perpendicular to edge 20**.

Blade 25 presents an elastic device (FIG. 5 detail) consisting of two helical springs **26*a*, 26*b* fitted coaxially on to pin 26 and having first end portions fitted to pin 26, and second end portions fitted on opposite faces of blade 25. Blade 25 is also connected to a first and second sensor 27*a*, 27*b* (e.g. microswitches) located at opposite ends of edge 20 and which are activated by opposite portions of blade 25 for detecting the impact on blade 25 of left or right portions 17*a*, 17*b* of edge 17**.

Blade 25 in fact rotates about axis 26 between a stable idle position, wherein it is parallel to edge 20, and two activating posit ions (not shown), wherein it activates the first or second sensor **27*a*, 27*b***.

Device 1 also presents a compressed air supply device 28 (shown schematically) having two nozzles 29 (only one shown for simplicity) located on either side of surface 14, close to edge 20.

Translating device 12 also comprises a push unit 30 consisting of a slide 33 traveling on surface 14 and having a flat surface 35 substantially perpendicular to surface 14. Slide 33 presents a lateral appendix 36 (FIG. 2) having a through hole 37 engaged by a straight guide 43 parallel to surface 14 and fitted to the same by two upright elements 47 (only one shown in FIG. 2) fitted to end portions of surface 14.

Slide 33 is moved along guide 43 by a toothed belt 51 driven by an actuator 52 (e.g. a d.c. motor) and coplanar with surface 14.

Pile 4 is arranged contacting surface 35, and the forward movement of slide 33 along guide 43 provides for feeding items 7 towards edge 20 of surface 14.

Surface 14 also presents a handling unit 56 comprising two pairs of belts 58 and 58' extending from end edge 20 to an opposite end edge 21 and presenting a straight portion coplanar with surface 14.

The two pairs of belts 58, 58' are arranged parallel to each other, travel independently in relation to surface 14 and at adjustable speed by virtue of respective (reversible) actuators 63, 64, and engage respective left and right portions **17*a*, 17*b* of bottom edge 17 of items 7**, as described later on.

Device 1 also comprises a grip and carry unit 70 located opposite straight edge 20 of surface 14, and which provides for gripping items 7 off translating device 12 and unloading them on to a conveyor belt device 75 located between unit 70 and surface 14.

Figure 3:
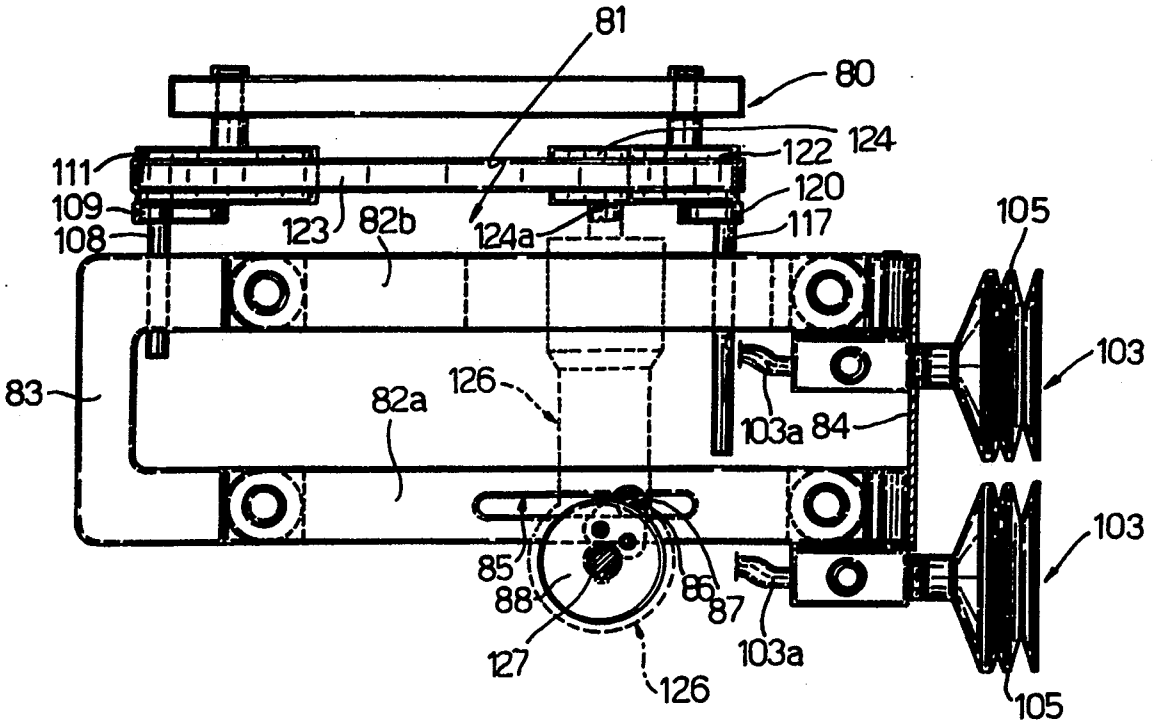
FIG. 3 shows a larger-scale top plan view of a detail of the FIG. 1 device.
Figure 4:
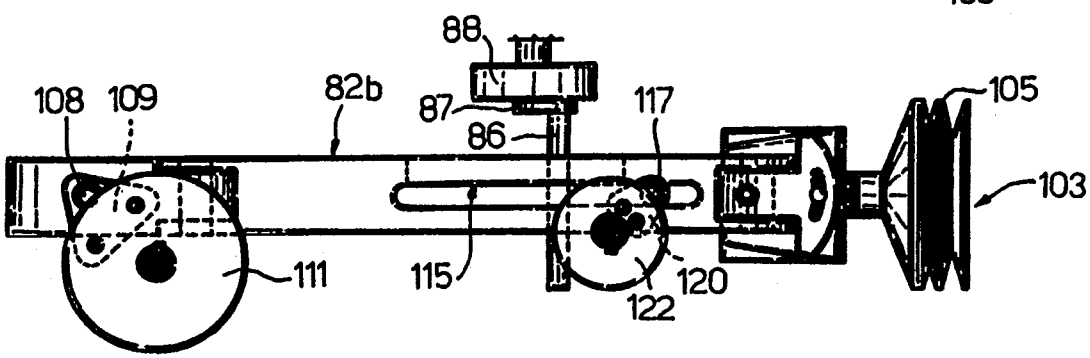
FIG. 4 shows a side view of the FIG. 3 detail.

As shown in FIGS. 1, 3 and 4, unit 70 comprises a vertical load-bearing structure 80 (shown schematically) fitted at the bottom to base 10, and supporting, at the top, a parallelogram device 81. Device 81 consists of two parallel arms 82*a*, 82*b* having first ends hinged to a C-shaped element 83, and second ends hinged to the ends of a straight crosspiece 84 fitted with two suction cups 103 (FIGS. 3 and 4) having an axially-deformable, bellows type end portion 105. Suction cups 103 (FIG. 3) are connected by hoses 103*a* to a device 104 (shown schematically in FIG. 1) for creating a vacuum by means of suction.

A first arm 82*a* of device 81 presents a longitudinal groove 85 engaged by a pin 86 on the end of a triangular appendix 87 fitted to a pulley 88. The axis of pulley 88 slopes horizontally by 10°, and pulley 88 is activated, as described later on, by an actuator 89 (FIG. 1), e.g. a low-inertia d.c. motor (shown schematically) connected to an angular position sensor (ENCODER) 89*a*. Actuator 89 operating pulley 88 thus provides for moving parallelogram device 81 in a plane sloping horizontally by 10°.

C-shaped element 83 is hinged to a pin 108 fitted to the end of a triangular appendix 109 extending radially from a vertical pulley 111 fitted to structure 80; and arm 82*b* presents a medial elongated longitudinal opening 115 engaged in sliding manner by a pin 117 fitted to an appendix 120 extending radially from a pulley 122 fitted to structure 80.

Pulley 122 is smaller in diameter than pulley 111, and is connected by a belt 123 to pulley 111 and to a bottom pulley 124 fitted to the horizontal output shaft 124*a* of an angular transmission 126 (shown by the dotted line) input-connected to motor 89. Angular transmission 126 also presents a vertical output shaft 127 to which pulley 88 is fitted.

Each arm 82*a*, 82*b* of device 81 thus moves reciprocatingly in crank and slotted link manner in a respective vertical plane and in a direction substantially perpendicular to edge 20 by actuator 89 operating pulleys 111, 122.

As a consequence, therefore, of the linked motion of arms 82*a*, 82*b* in parallel vertical planes and the movement of device 81 in a plane (not shown) sloping horizontally by 10°, suction cups 103 thus move in space according to a three-dimensional trajectory.

Conveyor belt device 75 is connected to a wall 150 (FIG. 2) located between unit 70 and translating device 12, and the bottom portion of which defines a U-shaped channel 151 parallel to edge 20.

Wall 150 comprises a first rectangular bottom portion 150*a* extending perpendicular to surface 14 and integral with a second top portion 150*b* having a rectangular top opening 155 enabling arms 82*a*, 82*b* to move towards translating device 12 for engaging items 7 as described later on.

With reference in particular to FIG. 1, the bottom of channel 151 is defined by a flat, elongated, rectangular wall 160 extending beneath and along the entire length of edge 20, and having an end portion 160*a* adjacent to the input 75*a* of conveyor belt device 75.

Conveyor belt device 75 comprises a first belt 170 extending over a straight flat portion 171 from a first pulley 174 adjacent to end 160*a*, to a second pulley (not shown).

Figure 5A:
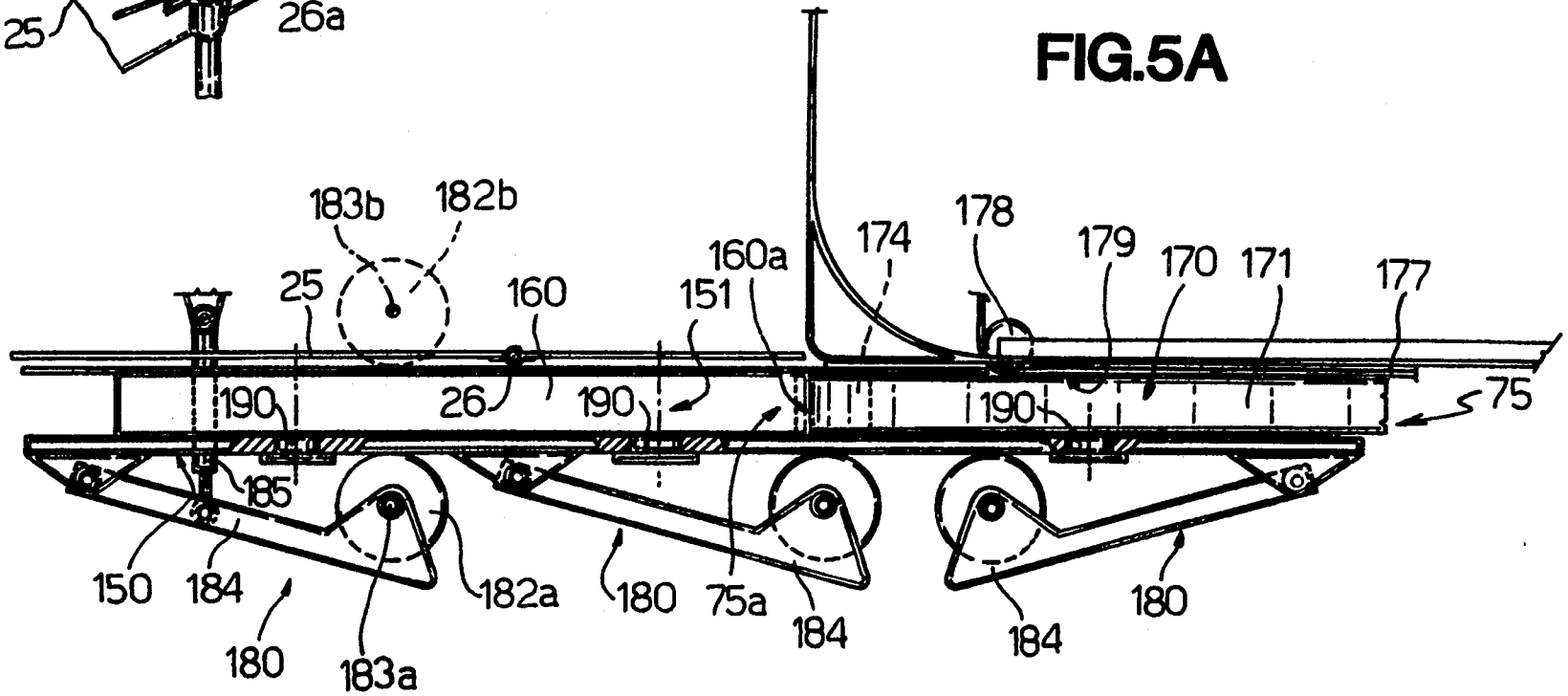
FIG. 5 shows a larger-scale top plan view of a portion of the FIG. 1 device.
Figure 5B:
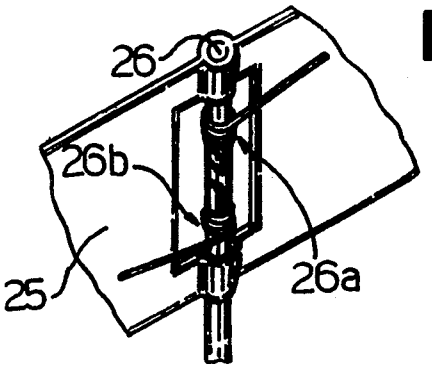

With special reference to FIG. 5, conveyor belt device 75 also comprises a second belt 177 extending parallel to belt 170 and between two rollers 178 (only one shown in FIG. 5) defining a straight flat portion 179 perpendicular to and to the side of flat portion 171.

Conveyor belt device 75 is assisted by a number of auxiliary grip and carry devices (pinch rollers) 180, each comprising a pair of drive rollers 182*a*, 182*b* arranged parallel to each other with respective vertical axes 183*a*, 183*b*, and the cylindrical outer surfaces of which are covered with elastic material.

Each roller 182*a* is fitted to the end of a flexible supporting device 184 hinged to wall 150 and which provides for pushing roller 182*a* towards roller 182*b* by virtue of an actuator 185, e.g. a pneumatic cylinder (shown schematically).

Two auxiliary gripping devices 180 are located along wall 160, and a third close to input 75*a* of conveyor belt device 75.

Rollers 182*a*, 182*b* of devices 180 provide for engaging opposite lateral portions of items 7, and for feeding items 7 towards conveyor belt device 75 and in a direction parallel to belts 170, 177.

Devices 180 are activated by respective sensors 190, e.g. photocells, fitted to wall 150 and mutually spaced along channel 151. Each sensor 190 provides for detecting the presence of an item 7 in channel 151 and accordingly closing respective device 180.

Device 1 also presents an optical sensor 200 (FIG. 2) comprising a photoemitting device (e.g. a LED) and photodetecting device (e.g. a phototransistor) defining an optical path 204 through which extends a gripping plane (P) coplanar with blade 25 and substantially perpendicular to surface 14 and to the 10° sloping plane in which parallelogram device 81 is moved by pulley 88.

Device 1 is connected to an electronic control unit 230 (FIG. 1) comprising a microprocessor unit 230*a* and an electronic power circuit 230*b*.

Unit 230 is supplied over respective lines (not shown) with the signals from optical sensor 200, limit stop sensors 27*a*, 27*b* and encoder 89*a*; is connected over respective control lines (not shown) to actuator 89, actuator 52 of belt 51, and actuators 63, 64 of belts 58, 58'; and controls suction device 104 for opening and closing suction cups 103.

Unit 230 also comprises an electronic torque limiting device 230*c* (shown schematically) for limiting the torque generated by motor 89 and so preventing the grip of suction cups 103 on item 7 from being exceeded, and for regulating acceleration of suction cups 103 as a function of the weight of item 7 and so preventing item 7 from being detached from suction cups 103 due to excessive inertia.

In actual use, pile 4 of items 7 is loaded by an operator on to surface 14, with the end item 7 contacting surface 35 of slide 33. Items 7 are normally arranged in nonparallel planes, in a disordered pile, with the planes of items 7 inclined in relation to gripping plane P through optical path 204 of sensor 200.

The sorting process is then started by electronic unit 230, and slide 33 is moved towards straight front edge 20, so as to feed the whole pile 4 of items 7 along surface 14 until the bottom edge 17 of the first item 7 contacts a portion of limit stop element 25, thus activating microswitch 27*a* or 27*b*.

At this point, electronic unit 230 arrests slide 33 and activates belt pair 58 or 58', which moves item 7, e.g. by a predetermined amount, so as to withdraw the portion of bottom edge 17 closest to edge 20 and by which microswitch 27*a* or 27*b* has been activated.

Items 7 thus rotate about their barycentric axis and are adjusted in position in relation to gripping plane P, which positioning process is repeated until bottom edge 17 of items 7 is parallel to edge 20.

Electronic unit 230 then moves slide 33 forward until the top edge of item 7 intercepts optical path 204 of sensor 200 and at the same time activates microswitches 27*a*, 27*b*. This indicates that item 7 is positioned coplanar with plane P, at which point electronic unit 230 arrests slide 33 and belts 58 and 58' and commences the unloading of item 7 off device 12.

Electronic unit 230 therefore starts motor 89 preparatory to gripping item 7 in plane P, and suction cups 103, moving in space along a three-dimensional path, approach gripping plane P laterally so as to contact and grip by suction the first item 7 in pile 4.

As of the above gripping position, suction cups 103 continue moving in a direction substantially parallel to edge 20, which movement is subsequently inverted and the suction cups accelerated rapidly upwards.

The above movement provides for detaching item 7 from pile 4, while the rapid acceleration to which item 7 gripped by suction cups 103 is subjected also provides for detaching it from an adjacent item possibly clinging to it. In the course of the above operations, detachment of items 7 is further assisted by blowing compressed air through nozzles 29.

At the end of the above operations, suction cups 103 move item 7 away from pile 4, accelerate in the direction of conveyor belt device 75, and release item 7 when the lateral speed of item 7 is parallel to the traveling direction of and close to that of conveyor device 75.

When released, item 7 travels along a parabolic path, which terminates upon straight edge 17 of item 7 coming to rest on belt 170.

Conveyor device 75 then feeds items 7 away from gripping unit 70, to enable performance of the next withdrawal cycle.

Any items 7 clinging to the one withdrawn by suction cups 103 are detached and drop down separately on to wall 160 of channel 151.

The presence of said items 7 is detected by sensors 190, which, via unit 230, close respective pinch rollers 180 by which items 7 are gripped and fed towards conveyor device 75.

More specifically, each sensor 190 detects the presence of one item 7, and, independently of the other sensors, activates a respective pinch roller 180 by which item 7 is gripped and fed towards conveyor device 75.

Pinch rollers 180 are closed, and consequently items 7 fed along channel 151, successively to prevent overlapping and interference between the items 7 traveling along channel 151. In particular, the pinch rollers closest to belt 171 are activated first.

The device according to the present invention clearly provides, therefore, for withdrawing items 7 from a substantially disordered pile 4.

This is achieved by precisely positioning item 7 in gripping plane P, so as to prevent more than one item from being withdrawn simultaneously; and correct gripping of the items by suction cups 103 is assured by virtue of the gripping edges of cups 103 being substantially coplanar with the front surface of item 7.

Moreover, each item 7 is safely detached from the next by virtue of the three-dimensional movement of arms 82*a*, 82*b* and the resulting variable-acceleration trajectory of suction cups 103.

The device according to the present invention provides for sorting a large number of items 7 per hour: roughly 5500–6500 items of small, constant size; 4000 items of various sizes; and 3500 items of average weight.

Pinch rollers 180 along channel 151 also provide for feeding to conveyor device 75 any items clinging to the one withdrawn by suction cups 103.

To those skilled in the art it will be clear that changes may be made to the device as described and illustrated herein without, however, departing from the scope of the present invention.

Figures 6A, 6B:
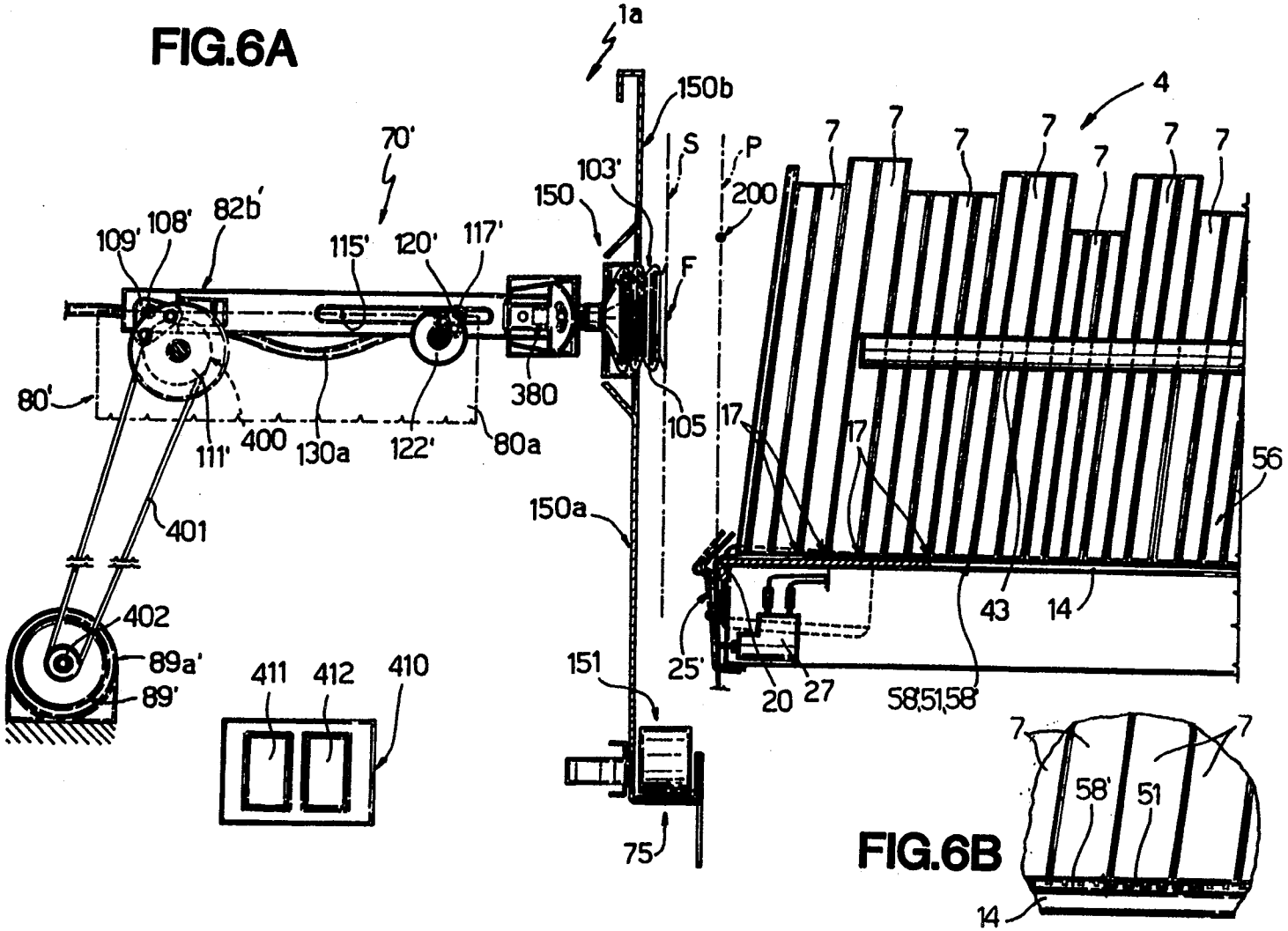
FIG. 6 shows a side view of a variation of the FIG. 1 device.

FIG. 6 shows a simplified sorting device 1*a* as compared with device 1 described above.

Any parts identical to those of device 1 are indicated only partially and using the same numbering system with no further description; any parts modified but similar to those already described are indicated using the same numbering system plus a (');; and any new parts are indicated using additional numbers.

Device 1*a* differs from device 1 by presenting a grip and carry unit 70', a handling unit 56' and a limit stop element 25', which are simplified as compared with those already described.

Group 70' comprises a vertical load-bearing structure 80' fitted at the bottom to base 10, and which, at the top, supports one arm 82*b'* moving reciprocatingly in crank and slotted link manner in a vertical plane and in a direction substantially perpendicular to edge 20 by an electric motor 89' fitted to base 10.

The front end of arm 82*b'* supports two suction cups 103', and the rear end is hinged to a pin 108' fitted to the end of a triangular appendix 109' extending radially from a pulley 111' having a shaft perpendicular to vertical wall 80*a* of structure 80'.

Arm 82*b'* presents a medial elongated longitudinal opening 115' engaged in sliding manner by a pin 117' fitted to an appendix 120' extending radially from a pulley 122'. Pulley 122' is mounted with its shaft perpendicular to vertical wall 80*a*, and is smaller in diameter than pulley 111'.

Pulley 111' is connected to a pulley 400 located on the opposite side of vertical wall 80*a* and connected by a toothed metal belt 401 to a pulley 402 fitted to the end of the output shaft of motor 89'.

As such, power is transmitted by belt 401 from motor 89' to pulley 400 and to pulley 111' operating arm 82*b'*.

The shaft of motor 89' is connected to an angular position sensor (ENCODER) 89*a'*.

The front end of arm 82*b'* presents a pressure transducer 380 for determining the weight of item 7 gripped by suction cups 103', and which may be employed for controlling acceleration of suction cups 103', during operation of arm 82*b'*, as a function of the weight of item 7, and so preventing item 7 from being detached from cups 103'.

Limit stop element 25' consists of a shaped tiltable blade rotating about a straight hinge parallel to and beneath edge 20, and which provides for activating one sensor 27 (e.g. a microswitch) located beneath surface 14.

Belts 58 and 58' do not operate independently, and are moved at constant speed and in the same directions by a single (reversible) actuator 63.

Device 1*a* is connected to an electronic control unit 410 comprising a microprocessor unit 411 and an electronic power circuit 412.

Unit 410 is supplied over respective lines (not shown) with the signals from optical sensor 200, limit stop sensor 27 and encoder 89*a'*; is connected over respective control lines to motor 87, actuator 52 of belt 51, and actuator 63 of belts 58, 58'; and controls suction device 104 to which it is connected over a control line (not shown).

In actual use, pile 4 is loaded on to surface 14 and fed by translating device 12 towards straight front edge 20 until the bottom edge 17 of the first item 7 in pile 4 contacts limit stop element 25', thus activating microswitch 27.

At this point, electronic unit 410 arrests slide 33 and activates belts 58 and 58', which move in the same direction and at the same speed, so as to move bottom edge 17 away from edge 20.

Items 7 thus rotate about their barycentric axis, so as to adjust their own plane in relation to gripping plane P.

Electronic unit 410 then moves slide 33 forward until the top edge of item 7 intercepts the optical path of sensor 200 and at the same time activates microswitch 27. This indicates that item 7 is positioned substantially coplanar with plane P, at which point electronic unit 410 arrests slide 33 and belts 58 and 58' and commences the unloading of item 7 off device 12.

To grip and unload item 7, electronic unit 410 activates motor 89' upon the optical path of sensor 200 being intercepted.

As pulley 400 is rotated, arm 82*b'* moves from the idle position towards device 12 at constantly increasing speed; and is subsequently slowed down as it nears plane P, so that its speed is practically zero when the front end of suction cups 103' is located in plane P and contacting item 7.

Suction device 104 being activated, cups 103' adhere to the front surface of item 7, at which point arm 82*b'* is moved upwards and away from device 12, thus removing item 7.

In the course of the above operation, the speed of arm 82*b'* is controlled to prevent item 7 from being detached from suction cups 103'. In particular, axial displacement of arm 82*b'* downstream from gripping plane P is absorbed by gradual compression and decompression of elastic portion 105 of suction cups 103', while the upward movement of the arm lifts item 7 over the top edge of limit stop element 25'.

Arm 82*b'* continues moving until the center of the front surface of suction cups 103' coincides with point F in plane S, and item 7 is thus positioned over conveyor device 75. Over the final portion of its travel, the speed of arm 82*b'* is reduced considerably; and suction device 104 is deactivated so as to release suction cups 103' and cause item 7 to drop down on to device 75.

Device 1*a* clearly provides, therefore, for withdrawing items 7 from a substantially disordered pile 4 by precisely positioning item 7 in gripping plane P, so as to prevent more than one item from being withdrawn simultaneously; and correct gripping of the items by suction cups 103' is assured by virtue of the gripping edges of cups 103' being substantially coplanar with the front surface of item 7.

Moreover, the crank and slotted link motion described of arm 82*b'*, resulting in a closed curved trajectory of suction cups 103', provides for initially raising item 7 and safely detaching it from the next item. Also, elastic distortion of portion 105 of suction cups 103' on contacting the front face of item 7 ensures a firm grip of the item in addition to compensating for any irregularity in the thickness of the same. Finally, control of the speed and acceleration of arm 82*b'* and suction cups 103' provides for low-speed operation at the gripping point and, consequently, firm grip of items 7; for subsequently so controlling acceleration as to prevent items 7 from being detached from cups 103'; and for minimizing overall withdrawal cycle time.

To those skilled in the art it will be clear that changes may also be made to device la as described and illustrated herein without, however, departing from the scope of the present invention.

For example, electromechanical limit stop sensor 27 may be replaced by an optoelectronic sensor having an optical path interceptable by the straight bottom edge 17 of items 7.

Optical sensor 200 may be assisted by others of the same type and having optical paths through plane P; and the signals generated by said sensors may be supplied to a NAND device designed to only emit an unloading enabling signal when all the input signals are zero, i.e. when all the optical paths are intercepted, thus providing for improved alignment of item 7 in relation to plane P.

Belts 58 and 58' may be replaced by a single belt running along surface 14 and of the same width as belts 58 and 58'.

Changes may also be made to the speed and acceleration control of motor 89', for differently controlling the movement of suction cups 103' within the gripping and unloading cycle; by means of encoder 89*a'*, changes may be made to the unloading and idle positions of suction cups 103'; and suction cups 103' may be temporarily arrested at the withdrawal and/or unloading points.

Similar changes may also be made to device 1.

We claim:

1. A sorting device for flat, rectangular items (7), characterized by the fact that it comprises:

at least one supporting surface (14) for supporting a pile (4) of said items (7);

gripping means (70; 70') facing an end edge (20) of said supporting surface (14) and having at least one gripping head (103; 103') designed to releasably engage the front surface of said items (7);

first handling means (30) activated by first drive means (52), having at least one portion (33) cooperating with said pile (4), and which provide for pushing said items (7) towards said edge (20); and sensor means (27*a*, 27*b*, 200; 27) for detecting the position of said item (7) in relation to a gripping plane (P);

said sensor means (27*a*, 27*b*, 200; 27) being designed to emit a signal for activating said gripping means (70; 70') upon said item (7) being positioned in said gripping plane (P); and said gripping means (70; 70') being moved by second drive means (89; 29') between at least a first position, wherein said head (103; 103') is positioned facing said item (7) and substantially coplanar with said gripping plane (P), and a second unloading position wherein said head (103; 103') is so positioned as to unload said item (7).

2. A device as claimed in claim 1, characterized by the fact that said gripping means (70) comprise at least one arm (82*a*, 82*b*; 82*b'*) moving in a first vertical plane substantially perpendicular to said gripping plane (P) and to said edge (20);

said arm (82*a*, 82*b*; 82*b*') supporting said gripping head (103).

3. A device as claimed in claim 1, characterized by the fact that said arm (82*a*, 82*b*) also moves simultaneously in a second plane perpendicular to said first vertical plane.

4. A device as claimed in claim 2, characterized by the fact that said arm (82*a*, 82*b*; 82*b*') moves reciprocatingly in crank and slotted link manner in said first vertical plane.

5. A device as claimed in claim 4, characterized by the fact that said arm (82*b*, 82*b*') presents a first end supporting said gripping head (103; 103'), and a second end hinged to a pin (108; 108') fitted to the end of an appendix (109; 109') extending radially from a drive pulley (111; 111') activated by said second drive means (89; 89');

said arm (82*b*; 82*b*') also presenting a medial elongated longitudinal opening (115; 115') engaged in sliding manner by a pin (117; 117').

6. A device as claimed in claim 3, characterized by the fact that said gripping device (70) comprises a parallelogram structure (81) consisting of a first and second arm (82*a*, 82*b*) parallel to each other and presenting first ends hinged to the ends of a first connecting element (83), and second ends hinged to the ends of a second connecting element (84) supporting said gripping head (103);

said first arm (82*a*) presenting a longitudinal groove (85) engaged by a pin (86) fitted eccentrically to a first pulley (88) substantially parallel to said second plane and powered by said second drive means (89) so as to activate and move said parallelogram device (81) in said second plane.

7. A device as claimed in claim 6, characterized by the fact that said first connecting element (83) is hinged to a pin (108) fitted to an appendix (109) extending radially from a second pulley (111);

said second arm (82*b*) presenting a medial elongated longitudinal opening (115) engaged in sliding manner by a pin (117) fitted to an appendix (120) extending radially from a third pulley (122);

said first and second arms (82*a*, 82*b*) moving in parallel vertical planes and to and from said edge (20) by virtue of the rotation of said second and third pulleys (111, 122).

8. A device as claimed in claim 8, characterized by the fact that said third pulley (122) is considerably smaller in diameter as compared with said second pulley (111).

9. A device as claimed in claim 1, characterized by the fact that operation of said second drive means (89; 89') is detected by an angular position sensor (89*a*; 89*a*').

10. A device as claimed in claim 1, characterized by the fact that said gripping means (70) move said head (103) along a three-dimensional trajectory.

11. A device as claimed in claim 1, characterized by the fact that it comprises limit stop means (25; 25') connected to said edge (20) and cooperating with a bottom portion (17) of said items (7) for defining a limit stop position;

said first sensor means (27*a*, 27*b*; 27) being connected to said limit stop means (25; 25') for detecting the impact of said bottom portion (17) on said limit stop means (25; 25') and generating a limit stop signal.

12. A device as claimed in claim 11, characterized by the fact that said limit stop means (25) comprise at least a substantially straight blade projecting from and substantially parallel to said end edge (20).

13. A device as claimed in claim 12, characterized by the fact that said blade (25) activates first and second sensor means (27*a*, 27*b*) respectively activated by the impact of bottom left or right portions (17*a*, 17*b*) of said item (7) on said blade (25).

14. A device as claimed in claim 1, characterized by the fact that it comprises second handling means (56) comprising at least one belt (58, 58') operated by actuating means (63, 64);

said belt (58, 58') presenting at least one straight portion substantially parallel to said supporting surface (14) and engaging a bottom portion (17) of said items (7);

said belt (58, 58') being designed to engage said bottom portion (17) of said items (7) and move it in relation to said edge (20).

15. A device as claimed in claim 14, characterized by the fact that said handling means comprise at least a first and second belt (58, 58') operated independently by respective actuating means (63, 64);

each said belt (58, 58') being designed to engage a respective bottom portion (17*a*, 17*b*) of said item (7) and move it in relation to said edge (20).

16. A device as claimed in claim 13, characterized by the fact that said first and second sensor means (27*a*, 27*b*) provide for generating first and second limit stop signals, and for respectively activating first or second belt (58, 58').

17. A device as claimed in claim 1, characterized by the fact that said first handling means comprise a body (33) moving along at least one straight guide, (43);

said body (33) presenting a surface (35) cooperating with said pile (4) of items (7) for pushing said items (7) towards said edge (20).

18. A device as claimed in claim 1, characterized by the fact that said gripping head comprises a pair of suction cups (103; 103') designed to releasably engage the front surface of said items (7).

19. A device as claimed in claim 18, characterized by the fact that each said suction cup (103) comprises an elastically compressible, bellows type end portion (105).

20. A device as claimed in claim 1, characterized by the fact that it comprises conveyor belt means (75) substantially aligned with said end edge (20) and which provide for transporting said item (7) released by said gripping means (70; 70').

21. A device as claimed in claim 20, characterized by the fact that it comprises an electronic control system (230) for controlling said second drive means (89) and so varying the speed of said gripping means (70) along a three-dimensional trajectory that the speed of said head (103), in said second unloading position, is substantially equal to the traveling speed and parallel to the traveling direction of said conveyor belt means (75).

22. A device as claimed in claim 20, characterized by the fact that said conveyor belt means (75) comprise at least a first belt (170) having an end 23. A device as claimed in claim 22, characterized by the fact that said conveyor belt means (75) are connected to at least one auxiliary grip and carry device (180) located along said channel (151) and comprising at least a pair of drive rollers (182*a*, 182*b*), the cylindrical outer surfaces of which are designed to engage lateral portions of said items (7), for feeding said items (7) in a direction parallel to the traveling direction of said conveyor belt means (75).

24. A device as claimed in claim 23, characterized by the fact that it comprises proximity sensor means (190) mutually spaced along said channel (151) and which provide for detecting the presence of said items (7) in said channel (151);

said proximity sensor means (190) being designed to activate respective said auxiliary gripping devices.

25. A device as claimed in claim 24, characterized by the fact that said proximity sensor means (190) comprise at least two separate independent sensors mutually spaced along said elongated wall (160);

each said sensor (190) being designed to activate a respective said auxiliary gripping device (180).

26. A device as claimed in claim 1, characterized by the fact that said supporting surface (14) comprises a ramp type end portion (14*a*) defining the front of said straight front end edge (20).

27. A device as claimed in claim 1, characterized by the fact that it comprises compressed air generating and distributing means having at least one nozzle (29) in the proximity of said edge (20) for blowing compressed air towards said pile (4) and so facilitating detachment of said items (7).

28. A device as claimed in claim 1, characterized by the fact that it comprises an electronic control system (230) for controlling said second drive means (89) and so varying acceleration of said gripping means (70) along a three-dimensional trajectory that said head (103), in said first position, travels initially in a direction substantially parallel to said edge (20), and then inverts its direction and is accelerated rapidly upwards.

29. A device as claimed in claim 1, characterized by the fact that said sensor means for detecting the position of said items (7) in relation to said gripping plane (P) comprise optoelectronic sensors (200) defining an optical path through said gripping plane (P).

30. A device as claimed in claim 1, characterized by the fact that said items comprise substantially rectangular mail items (7).

31. A device as claimed in claim 30, characterized by the fact that said mail items (7) are 200–380 mm long, 100–280 mm wide, up to 25 mm thick, and less than two kilograms in weight.

32. A device as claimed in claim 1, characterized by the fact that it comprises transducer means (380) connected to said gripping head (103') and designed to detect the weight of said item (7) gripped by said gripping head (103'); said transducer means (380) cooperating with said gripping means (70') and an electronic control system (230) for regulating acceleration of said gripping head (103') as a function of the weight of said item (7).

* * * * *

UNITED STATES PATENT AND TRADEMARK OFFICE

CERTIFICATE OF CORRECTION

PATENT NO. : 5,379,992

DATED : January 10, 1995

INVENTOR(S) : Holmes, Lawrence B. et al

It is certified that error appears in the above-identified patent and that said Letters Patent is hereby corrected as shown below:

Column 10, line 63, after "end", insert --portion facing one end (160a) of a flat elongated wall (160) defining the bottom of a channel (151) located between said gripping device (70) and said supporting surface (14).--

Signed and Sealed this

Twenty-fourth Day of October, 1995

*Attest:*

*Attesting Officer*

Bruce Lehman

BRUCE LEHMAN

*Commissioner of Patents and Trademarks*